US012780272B2

(12) United States Patent
Nishio

(10) Patent No.: US 12,780,272 B2
(45) Date of Patent: Nov. 3, 2026

(54) FASTENER-MONITORING DEVICE, FASTENER-MONITORING SYSTEM, AND FASTENER-MONITORING METHOD

(71) Applicant: Kawasaki Railcar Manufacturing Co., Ltd., Kobe (JP)

(72) Inventor: Yusuke Nishio, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 638 days.

(21) Appl. No.: 18/266,816

(22) PCT Filed: Dec. 15, 2020

(86) PCT No.: PCT/JP2020/046692
§ 371 (c)(1),
(2) Date: Jun. 13, 2023

(87) PCT Pub. No.: WO2022/130488
PCT Pub. Date: Jun. 23, 2022

(65) Prior Publication Data
US 2024/0043052 A1 Feb. 8, 2024

(51) Int. Cl.
*B61K 9/08* (2006.01)

(52) U.S. Cl.
CPC ..... *B61K 9/08* (2013.01)

(58) Field of Classification Search
CPC ..... B61K 9/08
See application file for complete search history.

(56) References Cited

U.S. PATENT DOCUMENTS

2007/0217670 A1 9/2007 Bar-Am

FOREIGN PATENT DOCUMENTS

JP 2010230527 A * 10/2010

OTHER PUBLICATIONS

International Preliminary Report On Patentability (Chapter I) mailed on Jun. 29, 2023, in corresponding PCT/JP2020/046692 with English translation, 12 pages.

* cited by examiner

*Primary Examiner* — Robert J McCarry, Jr.
(74) *Attorney, Agent, or Firm* — XSENSUS LLP

(57) ABSTRACT

A fastener monitoring device monitoring a fastener of a track on which a railroad car runs includes a processing unit calculating a total number of fastening of the fastener or a total number of detachment of the fastener per unit length of the track as an index value indicating a fastening state of the fastener in the track based on running data of the railroad car and fastening state data of the fastener during running of the railroad car.

20 Claims, 12 Drawing Sheets

FIG. 5

| FASTENING STATE DATA ACQUISITION TIME(s) | 0.02 | 0.04 | 0.07 | 0.10 | 0.13 | 0.17 | 0.22 | ・・ |
|---|---|---|---|---|---|---|---|---|
| FASTENING IS PRESENT | 0 | 0 | 1 | 0 | 0 | 0 | 1 | ・・ |

| TIME(s) | 0.01 | 0.02 | 0.03 | ・・・ |
|---|---|---|---|---|
| POSITION(m) | 0.56 | 1.60 | 2.8 | ・・・ |
| SPEED(m/s) | 30 | 32 | 32 | ・・・ |

| TIME(S) | $0<t\leq1$ | $1<t\leq2$ | $2<t\leq3$ | ・・・ |
|---|---|---|---|---|
| INDEX VALUE (PIECE/m) | 1.56 | 1.54 | 1.23 | ・・・ |
| POSITION(m) | $0<L\leq9.3$ | $9.3<L\leq20.6$ | $20.6<L\leq33$ | ・・・ |

FIG. 10

59

MONITORING INDEX

NUMBER OF FASTENING : 1.56 PIECE/m
(CONVERSION IN 25m 39 PIECES)

NUMBER OF DETACHMENT : 0.057 POSITION/m
(CONVERSION IN 25m TWO POSITIONS)

NUMBER OF UNKNOWN : 0.029 POSITION/m
(CONVERSION IN 25m ONE POSITION)

FASTENER-MONITORING DEVICE, FASTENER-MONITORING SYSTEM, AND FASTENER-MONITORING METHOD

CROSS-REFERENCES TO RELATED APPLICATIONS

The present application is a National Phase entry based on PCT Application No. PCT/JP2020/046692 filed on Dec. 15, 2020, the entire contents of which is incorporated herein by reference.

BACKGROUND

Technical Field

The present disclosure relates to a technique of monitoring a fastener of a track.

Background Art

Patent Document 1 discloses a technique of managing fastening devices based on a fastening device number individually allocated to the fastening devices.

BACKGROUND ART DOCUMENTS

Patent Document(s)

Patent Document 1: Japanese Patent Application Laid-Open No. 2010-230527

SUMMARY

A fastener monitoring device is a fastener monitoring device monitoring a fastener of a track on which a railroad car runs, including processing circuitry configured to calculate a total number of fastening of the fastener or a total number of detachment of the fastener per unit length of the track as an index value indicating a fastening state of the fastener in the track based on running data of the railroad car and fastening state data of the fastener during running of the railroad car.

According to the above configuration, the number of fastening or detachment of the fastener per unit length of the track is calculated as the index value indicating the fastening state of the fastener in the track. Thus, there is no need to individually manage the fastener by allocating a specific number to the individual fastener, and a data processing amount caused by a separate management of the fastener number can be reduced.

A fastener monitoring system includes: the fastener monitoring device described above; and a base side state monitoring device provided to a management base so that a processing result in the fastener monitoring device is transmitted via a communication network.

According to the above configuration, the fastener can be monitored in the base side monitoring device in the management base.

A fastener monitoring method is a fastener monitoring method of monitoring a fastener in a track on which a railroad car runs, including: detecting a running state of the railroad car and a fastening state of the fastener during running of the railroad car; determining at least one of presence or absence of the fastener or presence or absence of detachment of the fastener based on a detection result of the fastening state of the fastener; and calculating a total number of fastening of the fastener or a total number of detachment of the fastener per unit length of the track as an index value indicating a fastening state of the fastener in the track based on a running state of the railroad car which has been detected and a determination result of at least one of presence or absence of the fastener or presence or absence of detachment of the fastener.

According to the above method, the number of fastening or detachment of the fastener per unit length of the track is calculated as the index value indicating the fastening state of the fastener in the track. Thus, there is no need to individually manage the fastener by allocating a specific number to the individual fastener, and a data processing amount caused by a separate management of the fastener number can be reduced.

BRIEF DESCRIPTION OF DRAWINGS

FIG. 5 is a diagram illustrating an example of running history data, fastening state history data, and track association data.

FIG. 10 is a diagram illustrating another display example in the display device.

DESCRIPTION OF EMBODIMENTS

Figure 1:
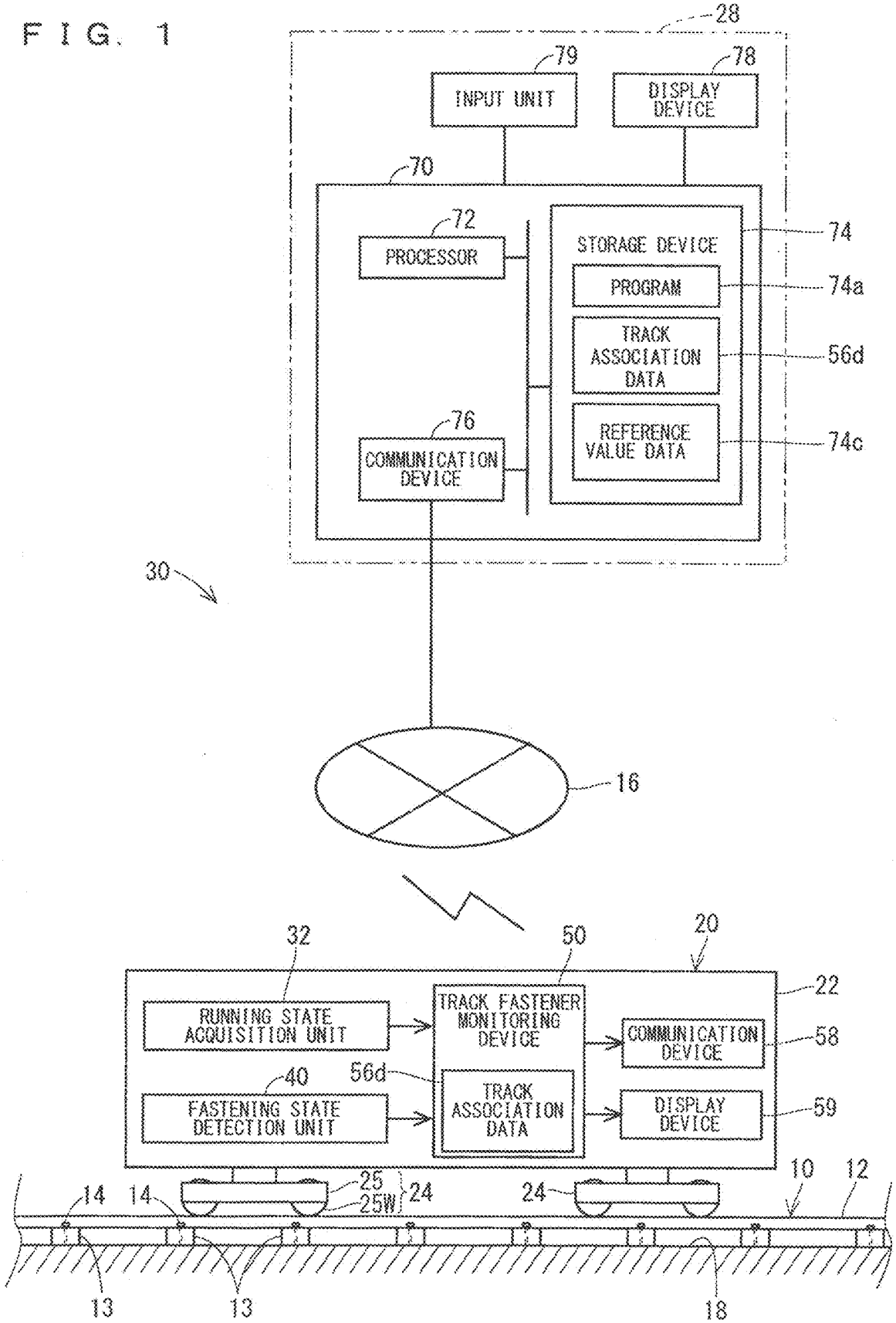
FIG. 1 is an explanation diagram illustrating an overall configuration of a fastener monitoring system according to an embodiment.

Described hereinafter is a fastener monitoring device, a fastener monitoring system, and a fastener monitoring method according to an embodiment. FIG. 1 is an explanation diagram illustrating an overall configuration of a fastener monitoring system 30.

One example of a track 10 monitored by the present system 30 is described. The track 10 is a road guiding a railroad car 20 along a predetermined path. The track 10 herein includes two rails 12. The two rails 12 are fixed to a laying surface 18 by a fastener 14. The laying surface 18 may be a surface of a land, a lower side surface in a tunnel, or an upper surface of a bridge or a via duct, for example. The track 10 may be a track including one rail guiding the railroad car, as in monorails.

The rails 12 may be fixed to the laying surface 18 via a tie 13. The tie 13 is a rectangular parallelepiped member intervening between the laying surface 18 and the two rails 12 to support the rails 12. That is to say, the ties 13 are disposed on the laying surface 18 in a parallel posture at intervals in an extension direction of the rails 12. The two rails 12 are disposed on the ties 13 in a posture perpendicular to the ties 13 at intervals in the extension direction of the ties 13. The rails 12 are fixed to the tie 13 by the fastener 14. A material of the tie 13 is not particularly limited, thus the tie 13 may be made of wood or concrete. The right and left rails 12 may be supported by the common tie 13, or right and left rails may also be supported by different ties. A tie plate may intervene between the tie 13 and the rails 12. A groove in which a base part of the rail can be disposed is formed in the tie plate. The rail 12 is disposed in the groove, thus the tie plate can support the rail from both sides.

It is sufficient that the fastener 14 can fasten the rail 12 to the tie 13 to keep the rail 12 in a constant position with respect to the tie 13. For example, the fastener 14 may be a spike fixing the rail 12 to the tie 13. The spike includes a spike body 14*a* and a head 14*b*, for example (refer to FIG. 2). The head 14*b* presses a base part of the rail 12 toward the tie 13 while the spike body 14*a* sticks in the tie 13. The spike may be a member referred to as a railroad spike, for example. When the tie plate intervenes between the tie 13 and the rail 12, the spike may pass through the tie plate to stick in the tie 13. In this case, the spike may press the rail 12 toward the tie 13, or may press the tie plate toward the tie 13 without pressing the rail 12 toward the tie 13. Any spike may constitute a part of the fastener 14. The spike may press the rail 12 toward the tie 13 via a leaf spring. Also in this case, the spike and the leaf spring may constitute a part of the fastener 14. Presence or absence of the fastener 14 or detachment thereof described hereinafter is determined for each spike, per unit of the spikes, per unit of the spike and the other tie plate, for example, or per unit of the right and left rails 12.

In this manner, it is sufficient that the fastener 14 fixes the rail 12 to the laying surface 18, thus applicable are various types of configuration referred to as a railroad spike, Pandrol rail fastener, E-clip, Vossloh type rail fastening, Surelok, Fastclip, Safelok, and Amsted, for example. Described in the present embodiment is an example that the fastener 14 is a spike such as a railroad spike pressing the rail 12 toward the tie 13 while sticking in the tie 13.

The railroad car 20 includes a body 22 and trucks 24. The trucks 24 each include a truck frame 25 and wheels 25W. The wheels 25W are rotatably supported in left and right portion of the truck frame 25 via an axle. A part supporting the axle is also referred to as an axle box. A direction of run and a direction of backing of the railroad car 20 are also respectively referred to as a forward direction and a backward direction in the present embodiment. Left and right sides are referred to left and right sides as viewed in the direction of run from the railroad car 20 in some cases. A side to which gravity is applied in a direction of gravity is also referred to as a lower side, and a side opposite the lower side is also referred to as an upper side. The right and left wheels 25W run on the two rails 12 while being guided by the rails 12. The trucks 24 support the body 22 from below. The trucks 24 run on the track 10, so that the railroad car 20 including the body 22 runs along the track 10. The railroad car 20 may be any of an electric train, a locomotive and a freight car of a freight train, and a locomotive and a passenger car of a passenger train as long as it runs on the track 10. The freight train or the passenger train may be a trailing car towed by the locomotive, or may be a motive power car having its motive power. The locomotive may be an electric locomotive, or may be an internal combustion locomotive, such as a diesel locomotive. The railroad car 20 may be a commercial car for transporting a human or a baggage, or may also be a business car for monitoring a track state. The railroad car 20 may be a land railer which can run on both a track and a road.

The fastener 14 described above may be detached in accordance with elapse of a time, for example. For example, it is considered that an inspector gets on a land railer to run on the rail 12, and visually inspects whether or not the fastener 14 is detached during running. It is also considered to visually inspect the detachment by patrolling by foot. In this case, personal cost increases.

According to the technique disclosed in Patent Document 1, there is a possibility that a data processing amount caused by a separate management of the fastener is enormous. Particularly, the number of the fasteners 14 is enormous in the rail 12 laid in a wide area, thus the data processing amount caused by the separate management of the fastener may be further enormous.

According to the fastener monitoring device, a fastener monitoring system, and a fastener monitoring method described in the present embodiment, a fastening state of the fastener 14 can be monitored, and particularly, it can be monitored whether or not the fastener 14 is in a fastening state necessary to fasten the rail 12 to the laying surface 18 without performing the separate management of the fastener 14.

As illustrated in FIG. 1, the fastener monitoring system 30 is the system for monitoring the fastening state of the fastener 14 in the track 10, and includes a running state acquisition unit 32, a fastening state detection unit 40, and a fastener monitoring device 50.

The running state acquisition unit 32 and fastening state detection unit 40 are provided to the railroad car 20. In the present embodiment, the fastener monitoring device 50 is also provided to the railroad car 20. A base side state monitoring device 70 is provided to a management base 28. The management base 28 is provided at a different location from the railroad car 20. For example, the management base 28 is architecture provided on the ground to monitor the railroad car 20. The fastener monitoring device 50 and the base side state monitoring device 70 are communicably connected to each other via a communication network 16. The fastener monitoring device 50 executes processing for monitoring an attachment state of the fastener 14 based on an output from the running state acquisition unit 32 and fastening state detection unit 40 during running of the railroad car 20. A processing result is displayed in a display device 59 provided to the railroad car 20. Accordingly, the attachment state of the fastener 14 is monitored in the railroad car 20 during running of the railroad car 20. The processing result achieved by the fastener monitoring device 50 is transmitted to the base side state monitoring device 70 via the communication network 16. Accordingly, the attachment state of the fastener 14 in the track 10 on which the railroad car 20 has run can be monitored in the management base 28. The communication network 16 may be a wired or wireless communication network, and may be a combination of the wired and wireless communication networks. The communication network 16 may be a public communication network or a communication network using a dedicated line. The base side state monitoring device 70 may be omitted.

The fastening state detection unit 40 detects the fastening state of the fastener 14 during running of the railroad car 20, and outputs fastening state data. It is sufficient that the fastening state detection unit 40 can detect a physical state served to determine whether the fastener 14 is in a state of fastening the rail 12 or in a state of being detached. For example, the fastening state detection unit 40 may include an imaging device taking an image of a lower side toward the rail 12 from a lower portion of the railroad car 20. The reason is that when imaging data around an intersection position where the rail 12 and the tie 13 intersect with each other is outputted as the fastening state data, the fastening state of the fastener 14 can be determined based on the imaging data. In this case, the imaging data may be still image data or video data. For example, the fastening state detection unit 40 may include a shape measurement device using an optical cutting method. The shape measurement device using the optical cutting method is a device irradiating the rail 12 and a region on both outer sides of the rail 12 with a slit light source, taking an image including a slit light in the image, and calculating a coordinate position of surfaces of the rail 12 and the region on both outer sides of the rail 12 based on the position of the slit in the taken image. The fastener 14 is reflected in the coordinate position of the surfaces of the rail 12 and the region on both outer sides of the rail 12. Thus, data of the coordinate position of the surfaces of the rail 12 and the region on both outer sides of the rail 12 may be used as the fastening state data. The fastening state detection unit 40 may detect a portion of the fastener 14 protruding from the tie 13 by a distance sensor such as a laser sensor, an ultrasonic sensor, or an optical sensor, and output the detection result as the fastening state data. The fastening state detection unit 40 may detect the fastener 14 as a metal component by a metal detection sensor such as a magnetic sensor, and output the detection result as the fastening state data.

The running state acquisition unit 32 acquires a running state of the railroad car 20 during running of the railroad car 20, and outputs running data. The running data indicating the running state may be data in which a speed or a position of the railroad car 20 can be specified directly or by calculation at a timing at which presence or absence of the fastener 14 or presence or absence of detachment thereof is determined based on the fastening state data from the fastening state detection unit 40. Herein, the position of the railroad car 20 is the position of the railroad car 20 in a longitudinal direction of the track 10. The position of the railroad car 20 may be a position (for example, kilometrage) based on a fixing position in the longitudinal direction of the track 10 (for example, starting point of a railroad or any station), or may also be a position based on an optional position in the longitudinal direction of the track 10. For example, the running state acquisition unit 32 may include a rotation number detection sensor detecting the number of rotations of the wheels, and output a running distance from a certain position based on the detection result of the rotation number detection sensor or a speed at constant time interval. A sensor detecting a speed of car based on the number of rotations in the railroad car 20 is also referred to as a speed generator in some cases. For example, the running state acquisition unit 32 may include an acceleration sensor detecting an acceleration rate in the direction of run of the railroad car 20, and output an acceleration rate based on the detection result of the acceleration sensor or a speed calculated based on the acceleration rate. For example, the running state acquisition unit 32 may include a global positioning system (GPS) receiving unit, and output latitude-longitude information acquired by a receiving signal from the GPS receiving unit or a position in the longitudinal direction of the track 10 based on the latitude-longitude information.

When the railroad car 20 runs, the fastening state detection unit 40 acquires the fastening state data from which presence or absence of the fastener 14 or presence or absence of the detachment thereof, and the running state acquisition unit 32 acquires the running data from which a speed or a position of the railroad car 20, at a timing at which presence or absence of the fastener 14 or presence or absence of the detachment thereof is determined, can be specified.

The running data from the running state acquisition unit 32 and the fastening state data from the fastening state detection unit 40 described above are given to the fastener monitoring device 50. The fastener monitoring device 50 monitors the fastener 14 of the track 10 on which the railroad car 20 runs. The fastener monitoring device 50 herein determines presence or absence of the fastener 14 and presence or absence of detachment thereof, and further provides an index value for determining whether or not the fastening state of the track 10 by the fasteners 14 is sufficient to support the track 10.

The fastener monitoring device 50 includes a processing unit calculating the number of fastening or detachment of the fastener 14 per unit length of the track 10 as the index value indicating the fastening state of the fastener 14 in the track 10 based on the running data from the running state acquisition unit 32 and the fastening state data from the fastening state detection unit 40.

The railroad car 20 is provided with a display device 59. The display device 59 may be a liquid crystal display device or an organic electro-luminescence (EL) display device, for example. A display device provided to a smartphone or a tablet terminal, for example, may be used as the display device 59. The display device 59 may be provided in a position such as a front position of a driver seat which can be visually recognized by a driver sitting in a driver seat, for example. The fastening state of the track 10 based on the calculation result by the processing unit in the fastener monitoring device 50 may be displayed in the display device 59. The state of the track 10 may be displayed in the display device 59 in real time during running of the railroad car 20. Accordingly, the driver, for example, can easily grasp an actual running position of the railroad car 20 and the fastening state in association with each other.

When the running data includes running position information of the railroad car 20, the processing unit in the fastener monitoring device 50 may generate track association data **56*d* in which the number of fastening or detachment of the fastener 14 per unit length of the track 10 is associated with the position of the track 10. The track association data 56*d* is an example of a processing result in the fastener monitoring device 50**.

The railroad car 20 is provided with a communication device 58. The communication device 58 includes a communication circuitry which can be connected to the communication network 16. The communication device 58 is a wireless communication device, for example. The fastener monitoring device 50 transmits the track association data **56*d* via the communication device 58. The track association data 56*d*** may be transmitted in real time, or may be transmitted at predetermined time intervals or at predetermined running distance intervals.

The transmitted track association data **56*d* is stored in the base side state monitoring device via the communication network 16. The base side state monitoring device 70 is made up of a computer including a processor 72 such as a CPU, a storage device 74, and a communication device 76, for example. The communication device 76 includes a communication circuitry, and is communicably connected to the fastener monitoring device 50 via the communication network 16. The base side state monitoring device 70** receives the track association data 56*d* transmitted from the fastener monitoring device 50 via the communication network 16, stores the track association data 56*d* in the storage device 74. The processor 72 executes processing according to a program 74*a* stored in the storage device 74 as a base side processing unit, thereby executing processing for monitoring the fastening state of the fastener 14 in the track 10. For example, the processor 72 compares the number of fastening or detachment of the fastener 14 per unit length of the track 10 in the track association data 56*d* with a preset reference value, thereby executing processing of determining a quality of the fastening state of the track 10. The reference value is a reference value empirically, experimentally, or deductively determined, and is previously stored in the storage device 74 as reference value data 74*c*.

A display device 78 and an input unit 79 are connected to the base side state monitoring device 70. The display device 78 may be a liquid crystal display device or an organic electro-luminescence (EL) display device, for example. A display device provided to a smartphone or a tablet terminal, for example, may be used as the display device 78. The input unit 79 receives commands from a user on the base side state monitoring device 70. The input unit 79 may be a key board, a mouse, a touch panel including switches, for example. The determination result of the quality of the fastening state of the track 10 described above may be displayed in the display device 78.

The track association data 56*d* transmitted from the railroad car 20 needs not be directly transmitted to the base side state monitoring device 70. For example, it is applicable that a data server is connected to the communication network 16, and the track association data 56*d* transmitted from the railroad car 20 is stored in the data server. The track association data 56*d* transmitted from the railroad cars 20 may be stored in the data server. In this case, the base side state monitoring device 70 may refer to the track association data 56*d* stored in the data server, thereby executing processing of monitoring the fastening state of the track 10.

A more specific example of each unit of the fastener monitoring system 30 is described.

Figure 2:
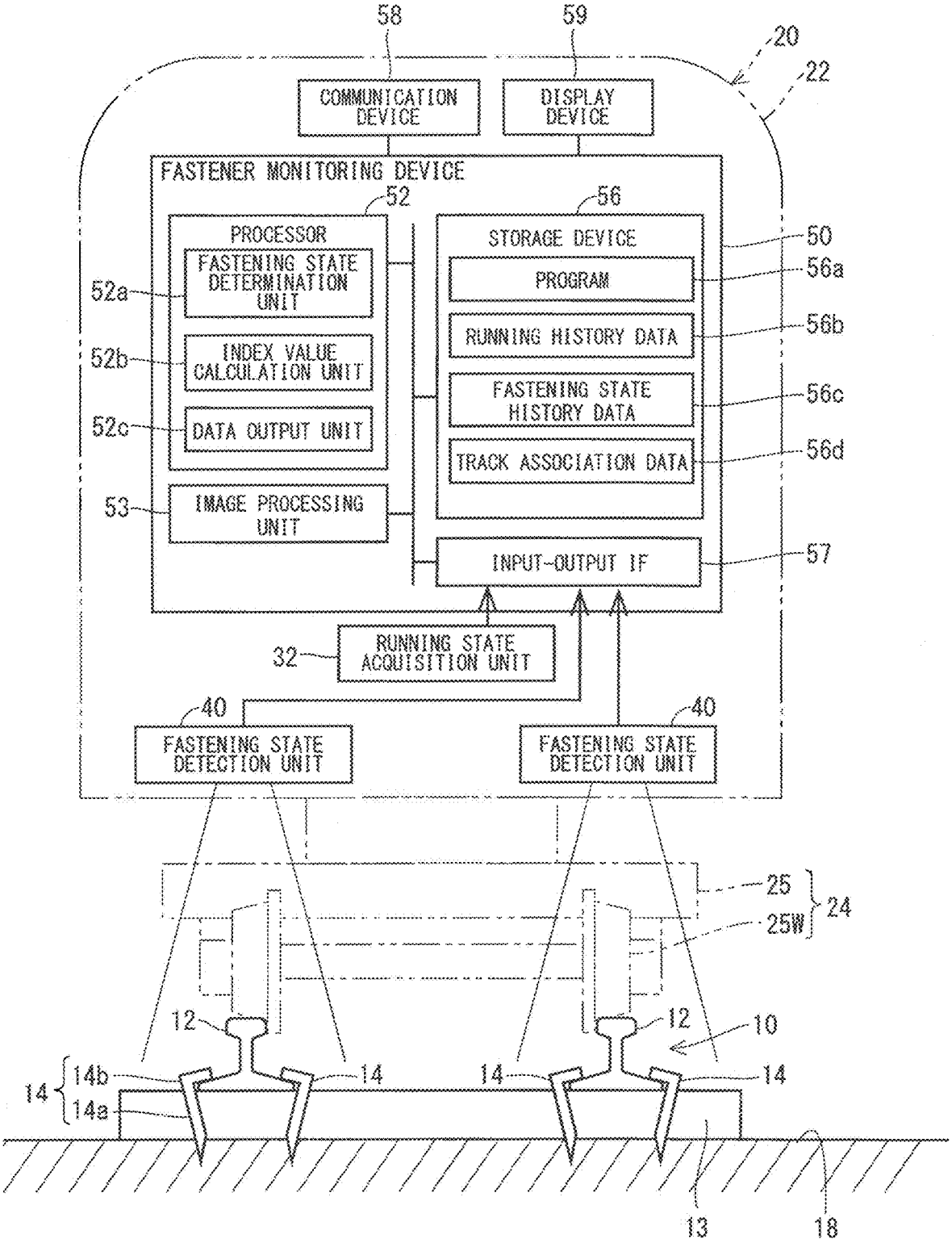
FIG. 2 is a block diagram illustrating an example of a running state acquisition unit, a fastening state detection unit, and a fastener monitoring device in a railroad car.

FIG. 2 is a block diagram illustrating the running state acquisition unit 32, the fastening state detection unit 40, and the fastener monitoring device 50.

As illustrated in FIG. 2, the railroad car 20 is provided with the running state acquisition unit 32. In the description of the present embodiment, the running state acquisition unit 32 acquires a speed and a running position (a position in the longitudinal direction of the track 10) of the railroad car 20 as the running state, and outputs the running data including the speed and the running position.

The railroad car 20 is provided with the fastening state detection unit 40. In the present embodiment, the fastening state detection unit 40 is an imaging device. The fastening state detection unit 40 may include an illuminating device illuminating an imaging range. The fastening state detection unit 40 is located in a downward posture on right and left sides of the railroad car 20. The fastening state detection unit 40 takes an image of the rail 12 on the right or left side and an adjacent region thereof (a region including the fastener 14 in the image), and outputs the imaging data to the fastener monitoring device 50.

Figure 3:
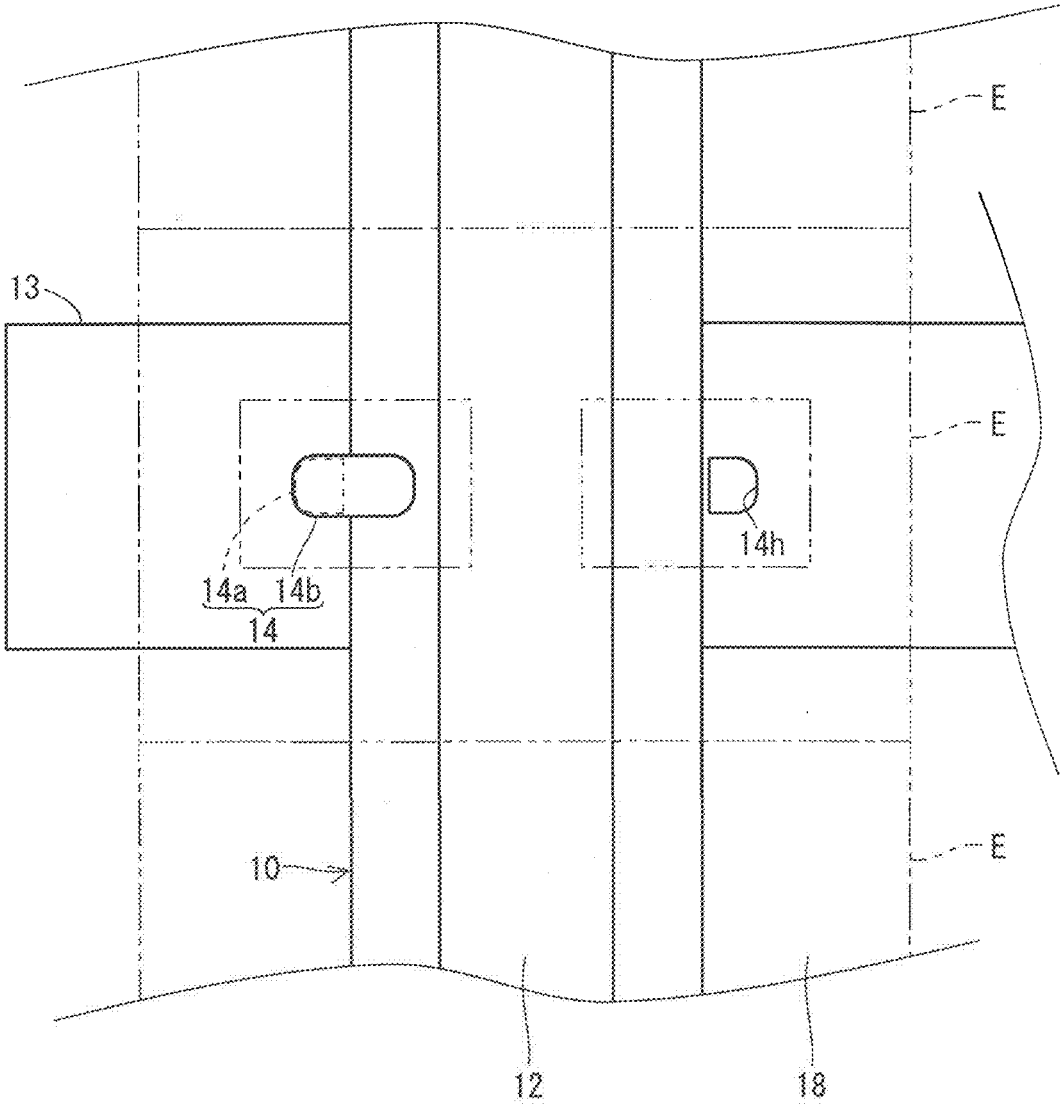
FIG. 3 is an explanation diagram illustrating a rail, a tie, and a fastener which can be observed from the railroad car.

FIG. 3 is an explanation diagram illustrating the rail 12, the tie 13, and the fastener 14 which can be observed from the railroad car 20. As illustrated in FIG. 3, the tie 13 extends to be perpendicular to the rail 12 on a lower side of the rail 12. The fastener 14 is observed on both sides of the rail 12. The fastener 14 is herein a spike such as a railroad spike, and two spikes are hammered in the tie 13 on both outer sides of the base part of the rail 12. The head 14*b* of the fastener 14 presses the base part toward the tie 13 while the head 14*b* has contact with an outer side edge portion of the base part. FIG. 3 exemplifies a trace (hole) 14*h* from which the fastener 14 is detached on the right side of the rail 12.

The fastening state detection unit 40 takes an image of a region E including the rail 12 described above and both outer sides thereof from a lower portion of the railroad car 20. Both outer side regions of the rail 12 is a region including the fastener 14 in the image. The fastening state detection unit 40 may take a still image or a video. When the fastening state detection unit 40 takes a still image, it is sufficient that a shooting time interval is controlled in accordance with a speed of the railroad car 20 so that images of shooting regions E adjacent to each other can be continuously taken along the longitudinal direction of the rail 12. For example, the still image may be taken at an interval obtained by dividing a dimension of the shooting region in the longitudinal direction of the rail 12 (or a dimension smaller than the dimension of the shooting region in consideration of overlap of the shooting region) by the speed of the railroad car 20. The shooting interval of the fastening state detection unit 40 may be controlled by the fastener monitoring device 50 or a computer provided separately. When the fastening state detection unit 40 takes a video, a still image may be cut out of the video at the interval similar to that described above. In these cases, the fastener monitoring device 50 performs image recognition processing on the still image, for example, thereby determining that the fastener 14 is present or in a state of being detached. It is also applicable that data of the video is given to the fastener monitoring device 50 as it is, and the fastener monitoring device 50 determines presence or absence of the fastener 14 based on the video, for example.

The running data acquired by the running state acquisition unit 32 and the fastening state data detected by the fastening state detection unit 40 described above are outputted to the fastener monitoring device 50.

The fastener monitoring device 50 is made up of a computer including a processor 52 such as a CPU, an image processing unit 53, a storage device 56, and an input-output interface 57, for example. The input-output interface 57 is an example of an input unit to which the running data and the fastening state data described above are inputted.

The processor 52 includes a calculation circuitry. The processor 52 is an example of a processing unit calculating the number of fastening or detachment of the fastener 14 per unit length of the track 10 as an index value indicating the fastening state of the fastener 14 in the track 10 based on the running data and the fastening state data. The image processing unit 53 is made up of a field-programmable gate array (FPGA) or a graphics processing unit (GPU) including circuitry, for example. The processing performed by the image processing unit 53 may be performed by the processor 52. The storage device 56 is made up of a nonvolatile storage device, such as a hard disk drive (HDD) and a solid-state drive (SSD). The storage device 56 stores a program 56*a*, running history data 56*b*, fastening state history data 56*c*, and the track association data 56*d*.

Processing for the processor 52 to achieve a function as the processing unit is described in the program 56*a*. Accordingly, the processor 52 executes the processing described in the program 56*a* stored in the storage device 56, for example, thus the processing as the processing unit calculating an evaluation value is executed. For example, the processor 52 executes each function as a fastening state determination unit 52*a* determining the fastening state, an index value calculation unit 52*b*, and a data output unit 52*c* described hereinafter. The number of the processors 52 may be one, or a plurality of processors 52 are also applicable. The processors 52 may be incorporated into one computer. It is also applicable that the processors 52 are incorporated into computers, and the computers separately perform processing as the processing units calculating the evaluation value. The running history data 56*b* is history data based on data acquired by the running state acquisition unit 32. For example, the running history data 56*b* is generated as data in which a position and a speed in the longitudinal direction of the track 10 are associated with a time corresponding to a sampling cycle. The running data is inputted from the running state acquisition unit 32, thus the running history data 56*b* is sequentially generated and updated. The fastening state history data 56*c* is data in which presence or absence of the fastener 14 or presence or absence of detachment thereof is associated with a time or a position in the longitudinal direction of the track 10 based on the fastening state data detected by the fastening state detection unit 40. For example, the fastening state history data 56*c* is generated as history data in which determination of presence or absence of the fastener 14 is associated with a time when the fastening state data is acquired (shooting time) (refer to FIG. 5). The fastening state history data 56*c* may be sequentially generated and updated every time the fastening state detection unit 40 takes the image or inputs the fastening state data and every time the fastening state of the fastener 14 is determined as described hereinafter. The running history data 56*b* and the fastening state history data 56*c* may be deleted after the evaluation value is obtained. The track association data 56*d* is data in which the number of fastening or detachment of the fastener 14 per unit length of the track 10 calculated based on the running history data 56*b* and the fastening state history data 56*c* is associated with the position of the track 10. The track association data 56*d* is transmitted to the base side state monitoring device 70 from the communication device 58 via the communication device 58. The track association data 56*d* may be transmitted at predetermined time intervals or at predetermined running distance intervals. The track association data 56*d* may be deleted after being transmitted.

A processing example as the processing unit in the fastener monitoring device 50 is described with reference to a flow chart illustrated in FIG. 4.

A count variable is set to an initial value 0 in Step S1.

The fastening state data is inputted from the fastening state detection unit 40 to the fastener monitoring device 50 in subsequent Step S2.

Preprocessing is executed on the fastening state data in subsequent Step S3. Herein, the fastening state data is image data including an image taken by the fastening state detection unit 40. Noise removal processing, for example, is executed as the preprocessing. The preprocessing may be performed by the image processing unit 53.

The fastening state of the fastener 14 is determined based on the fastening state data in subsequent Step S4. The fastening state of the fastener 14 may be determined based on a state where the fastener 14 is present, or may also be determined based on a state where the fastener 14 is detached. That is to say, it may be determined that fastening is present when the fastener 14 is included in the image. For example, it may be determined that the fastener 14 is detached when a trace (a hole as a spike hole) in which the fastener 14 has sticked is included in the image. The fastening state of the fastener 14 may be determined based on a reliability score in detecting an object by a learned model which is mechanically learned or template matching processing on the image.

Presence of the fastener 14 or a detachment state of the fastener 14 may be determined for each spike constituting the fastener. For example, at least two spikes are provided in an intersection position where the rail 12 and the tie 13 intersect with each other, thus presence or absence of the fastener 14 or presence or absence of detachment thereof may be determined for each spike. Presence of the fastener 14 or a detachment state of the fastener 14 may be determined for each intersection position where the rail 12 and the tie 13 intersect with each other. For example, at least two spikes are provided in an intersection position where the rail 12 and the tie 13 intersect with each other, thus it may be determined that fastening of the fastener 14 is present when all spikes are present, and detachment of the fastener 14 is present when at least one position where the spike is detached is present. Presence or absence of the fastener 14 or presence or absence of detachment of the fastener 14 may be determined on the right and left rails 12 separately, or may also be determined on the right and left rails 12 integrally.

When presence or absence of the fastener 14 or presence or absence of detachment thereof is determined for each set of the plurality of spikes, presence or absence of the spikes or presence or absence of detachment thereof may be determined for each spike, or may also be determined for each set of the plurality of spikes.

As described above, when the fastener 14 includes a tie plate or a leaf spring, presence or absence of the fastener 14 may be determined in accordance with presence or absence of the tie plate or the leaf spring, for example.

Description hereinafter in the present embodiment is an example that it is determined that the fastener 14 is present when it is determined that two spikes are present in the fastening state data of each of the right and left rails 12 at the same time (when it is determined that four spikes in total are present) based on an premise that one spike is provided to each of the right and left sides of each of the right and left rails 12 (refer to FIG. 3). That is to say, it is determined that the fastener 14 is present when the right and left rails 12 are normally fastened to the tie 13 by the fastener 14. Thus, it is determined that there is no fastener 14 when the shooting image includes the tie 13 but all of four spikes are not present and when the shooting image does not include the tie 13 itself, thus does not include any spike. A time of acquiring the fastening state data (for example, the shooting time) is associated with the determination of presence or absence of the fastener 14 based on the determination of presence or absence thereof, and the fastening state history data 56*c* is generated and updated.

When it is determined that fastening of the fastener 14 is present in Step S4, processing proceeds to Step S5. 1 is added to the count variable in Step S5.

When it is determined that there is no fastener 14 in Step S4, and after processing of Step S5, processing proceeds to Step S6. It is determined in Step S6 whether or not an elapsed time after counting is started is equal to or longer than a preset reference time. The elapsed time is an elapsed time based on a processing time in which a count variable is set to an initial value 0, for example. The reference time is a time appropriate to monitor a change of the fastening state of the fastener 14, and is set to one second, for example. When it is determined in Step S6 that the elapsed time is not equal to or longer than the reference time, the processing returns to Step S2 to repeat the processing described above, and when it is determined that the elapsed time is equal to or longer than the reference time, the processing proceeds to Step S7.

The evaluation value is calculated in Step S7. For example, the number of fastening of the fastener 14 per unit immediately preceding time (the reference time herein) is obtained based on the fastening state history data 56*c*. An average speed of the railroad car 20 per unit immediately preceding time (the reference time) is calculated by referring to the running history data 56*b*. Then, the number of fastening of the fastener 14 per unit length of the track 10 is obtained as the evaluation value by multiplying the number of fastening of the fastener 14 per unit time (the reference time herein) by the speed of the railroad car 20. The speed of the railroad car 20 is an average speed until the reference time passes, for example, and can be obtained based on the running history data 56*b*.

In subsequent Step S8, the obtained evaluation value is outputted as data. The evaluation value may be displayed in the display device 59 based on this output. It is also applicable that a running position based on the running history data 56*b* is associated with the outputted evaluation value and is stored in the storage device 56 as the track association data 56*d*.

It is determined in subsequent Step S9 whether or not the running is finished based on the output from the running state acquisition unit 32. When it is determined that the running is not finished, the processing returns to Step S1 and the processing described above is repeated. Accordingly, the number of fastening of the fastener 14 per unit length is sequentially calculated in each position of the track 10 during running of the railroad car 20. When it is determined that the running is finished in Step S9, the processing is finished.

The processing from the present Steps S1 to S9 is performed during running of the railroad car 20. Thus, the number of fastening of the fastener 14 per unit length of the track 10 can be sequentially grasped during running of the railroad car 20.

FIG. 5 illustrates an example of the running history data 56*b*, the fastening state history data 56*c*, and the track association data 56*d*. The running history data 56*b* is data in which a position and a speed of the railroad car 20 in the longitudinal direction of the track 10 are associated with a time of a predetermined sampling cycle, for example. The fastening state history data 56*c* is data in which presence or absence of the fastener 14 is associated with a time of acquiring the fastening state data (for example, the shooting time), for example. The number of fastening of the fastener 14 in a predetermined reference time (for example, one second) is obtained by referring to the fastening state history data 56*c*. An average speed of the railroad car 20 per unit predetermined reference time is obtained by referring to the running history data 56*b*. The number of fastening of the fastener 14 per unit length is calculated as the index value by multiplying the number of fastening of the fastener 14 per unit predetermined reference time by an average speed of the railroad car 20. The index value may be calculated as the number of fastening per meter, for example. At this time, the position of the railroad car 20 can also be specified by referring to the running history data 56*b*. Data in which the number of fastening of the fastener 14 per unit length and the position of the railroad car 20 are associated with each reference time may be generated as the track association data 56*d*, for example.

Figure 6:
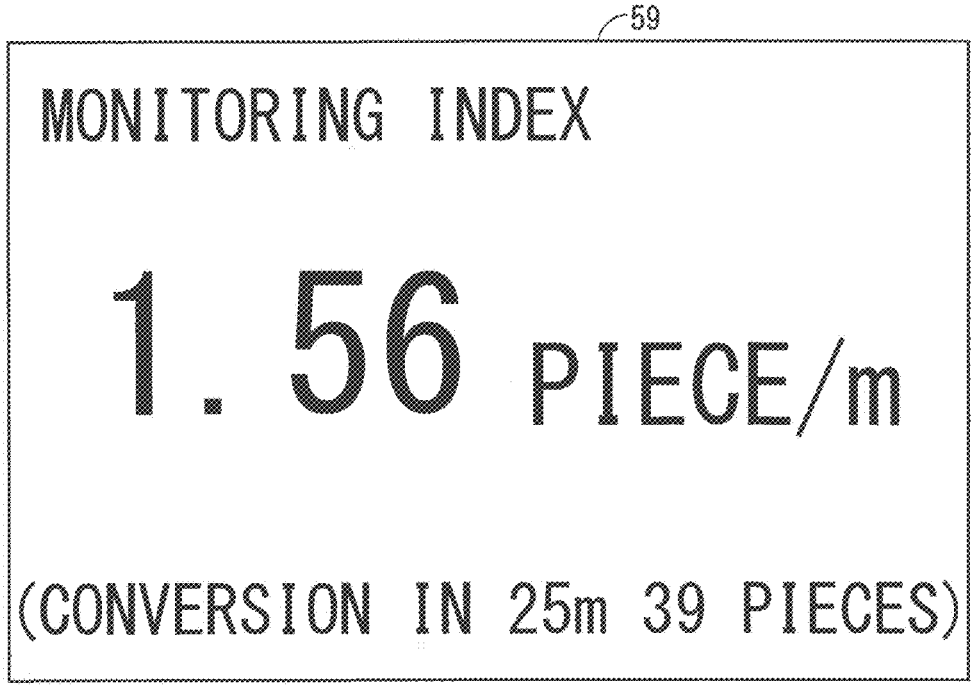
FIG. 6 is a diagram illustrating a display example in a display device.

FIG. 6 is a diagram illustrating a display example in the display device 59. The fastening state of the track 10 is displayed in the display device 59 during running of the railroad car 20 based on the processing result in the fastener monitoring device 50. The fastening state of the track 10 may be expressed by the number of fastening (index value) of the fastener 14 per unit length, or a result of comparing the index value with the reference value may be displayed. Displayed in FIG. 6 is the number of fastening (1.56/m in FIG. 6) of the fastener 14 per unit length (for example, 1 m) as a monitoring index. The number of fastening (39 in FIG. 6) in a case where the unit length is converted into 25 m is also displayed.

Unit length is not particularly limited. The reason why two index values are displayed with changed unit length in FIG. 6 is as follows. That is to say, the reference value of the number of fastening of the fastener 14 with respect to the track 10 is determined for each length of one rail 12, for example, in some cases. For example, the number of fastening of the fastener 14 is determined by each length of the rail (25 m, for example) in accordance with a speed and an annual designed passing tonnage of the railroad car 20 passing on the track 10. From this point, the unit length may be a magnitude corresponding to the length such as a length of the rail, for example. The unit length is preferably small to grasp the fastening state of the fastener 14 in the track 10 as specifically as possible. When the index value is displayed by a small distance unit (for example, 1 m) during running of the railroad car 20, a portion having a small number of fastening of the fastener 14 can be easily grasped by a meter unit.

Thus, it is also applicable that a first unit length (for example, 1 m) and a second unit length (for example, 25 m) larger than the first unit length are set as the unit length of the track 10, and the fastener monitoring device 50 calculates the number of fastening of the fastener 14 per first unit length based on the running data and the fastening state data, and calculates the number of fastening of the fastener 14 per second unit length based on this calculation result. An example of displaying two types of index value is displayed in such a case in FIG. 6. The second unit length may be a value corresponding to the length of the rail.

It is applicable that the fastener monitoring device 50 compares the index value with the preset reference value, and displays an image of drawing attention in the display device 59 when the number of the fasteners 14 per unit length is equal to or smaller than the reference value. The image of drawing attention may be an image of drawing attention by a character, a symbol, or a color, for example.

Mainly described above is the example that the fastener monitoring device 50 determines presence or absence of the fastener 14 and calculates the number of fastening of the fastener 14 per unit length, however, the fastener monitoring device 50 may determine a position where the fastener 14 is detached to calculate the number of detachment of the fastener 14 per unit length in place of or in addition to the above configuration. In this case, the number of detachment of the fastener 14 per unit length may be displayed in the display device 59.

Figure 7:
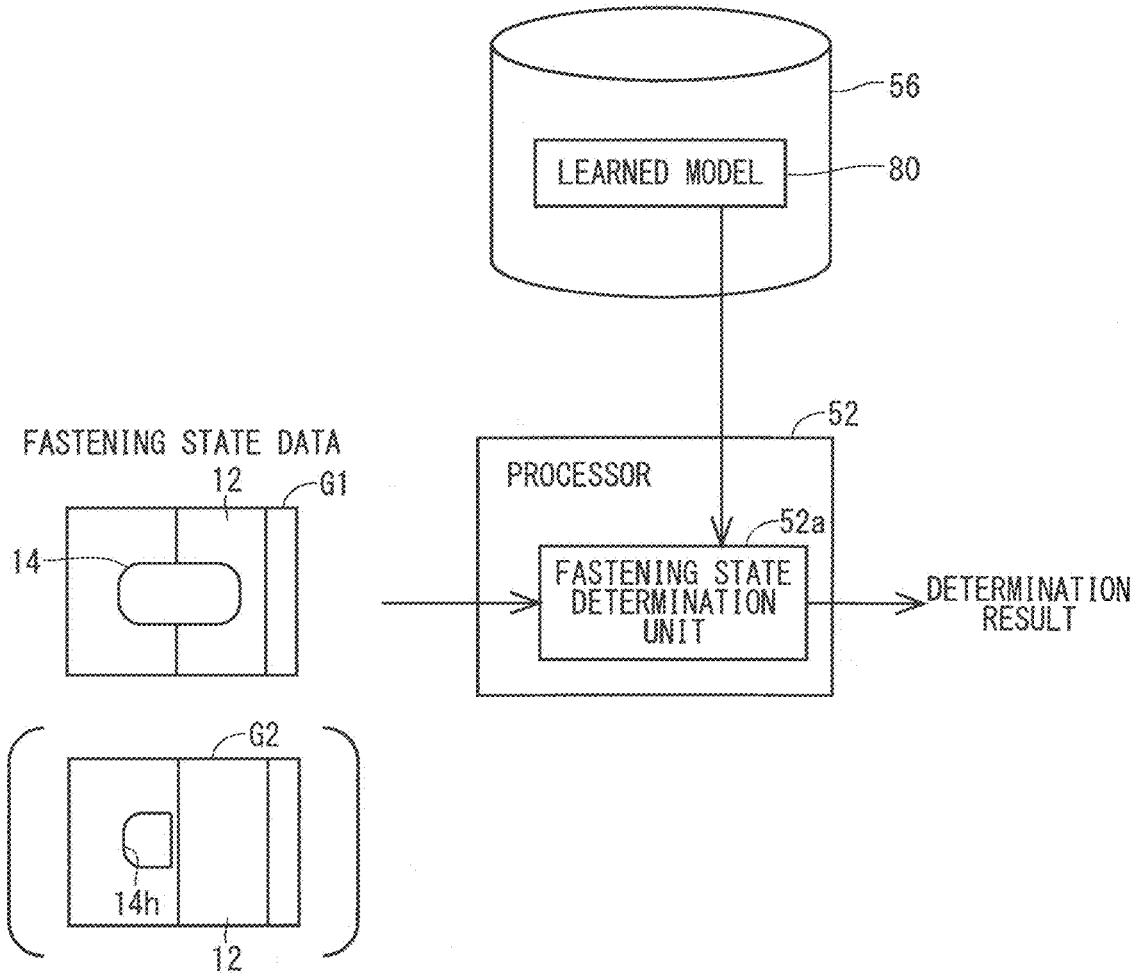
FIG. 7 is an explanation diagram illustrating an example of a learned model.
Figure 8:
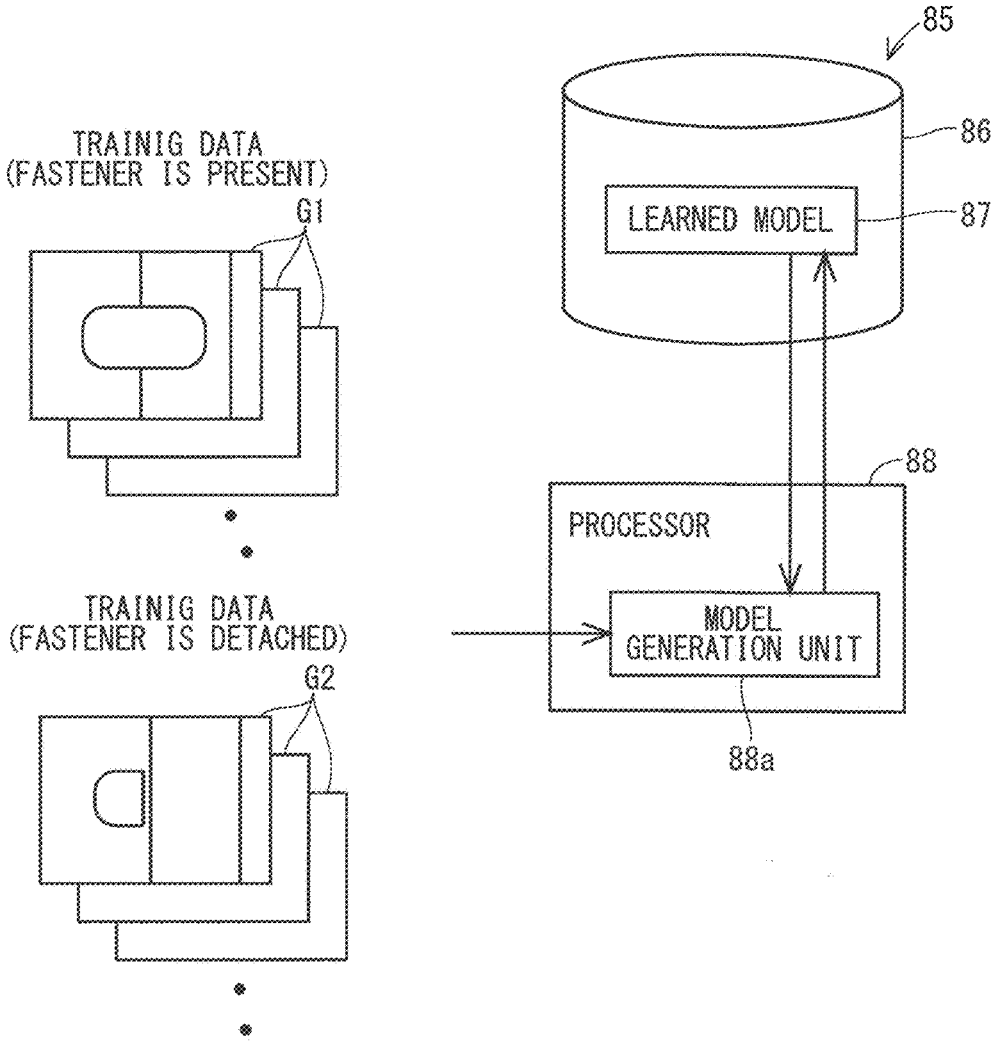
FIG. 8 is an explanation diagram illustrating a state during learning of a learning model.

The fastening state of the fastener 14 in Step S4 described above may be determined by a learned model 80 which is mechanically learned as illustrated in FIG. 7. The learned model 80 is made up of a multilayer neural network, and stored in the storage device 56, for example. The processor 52 reads out a program and a parameter described in the learned model to execute identification processing, thereby executing processing as a fastening state determination unit 52*a* (inference unit). For example, images G1 and G2 as the fastening state data are inputted to the learned model 80, thus at least one of presence or absence of the fastener 14 or presence or absence of detachment thereof is determined.

The learned model 80 is generated by a mechanical learning device 85 made up of a computer including a storage device 86 storing a learning model 87 and a processor 88 including a model generation unit 88*a*, for example. The model generation unit 88*a* learns presence or absence of the fastener 14 or presence or absence of detachment thereof based on learning data generated based on a combination of image data of the fastening state of the fastener 14 outputted from the storage device 56 or the fastening state detection unit 40 and correct data of the fastening state of the fastener 14 as training data. That is to say, the learned model 80 inferring presence or absence of the fastener 14 or presence or absence of detachment thereof is generated from the image data of the fastening state of the fastener 14 and the training data. Herein, the learning data is data in which the image data of the fastening state of the fastener 14 and the correct data of the fastening state of the fastener 14 as the training data are associated with each other. The correct data (fastened or nor fastened) may be associated to the image data by an operator. The training data may be an image G1 group including the fastener 14 for determining that the fastener 14 is present, an image G2 group including the trace 14*h* from which the fastener 14 is detached for determining that the fastener 14 is detached, or both of them.

When the fastening state data includes a state where the fastening state of the fastener 14 is unknown, the fastener monitoring device 50 may calculate the number of unknown of fastening of the fastener 14 per unit length of the track 10 as reference information. That is to say, even when presence or absence of the fastener 14 or presence or absence of detachment thereof is determined from the image, there is a possibility that an image of a position where the fastener 14 should be present cannot be sufficiently taken due to an object (plant, for example) on the fastener 14. In such a position, it is considered that the fastening state is originally grasped as unknown of fastening instead of determination of the fastening state that the fastener 14 is present or detachment is present. Thus, the number of unknown of fastening of the fastener 14 per unit length of the track 10 may be calculated as reference information.

Figure 9:
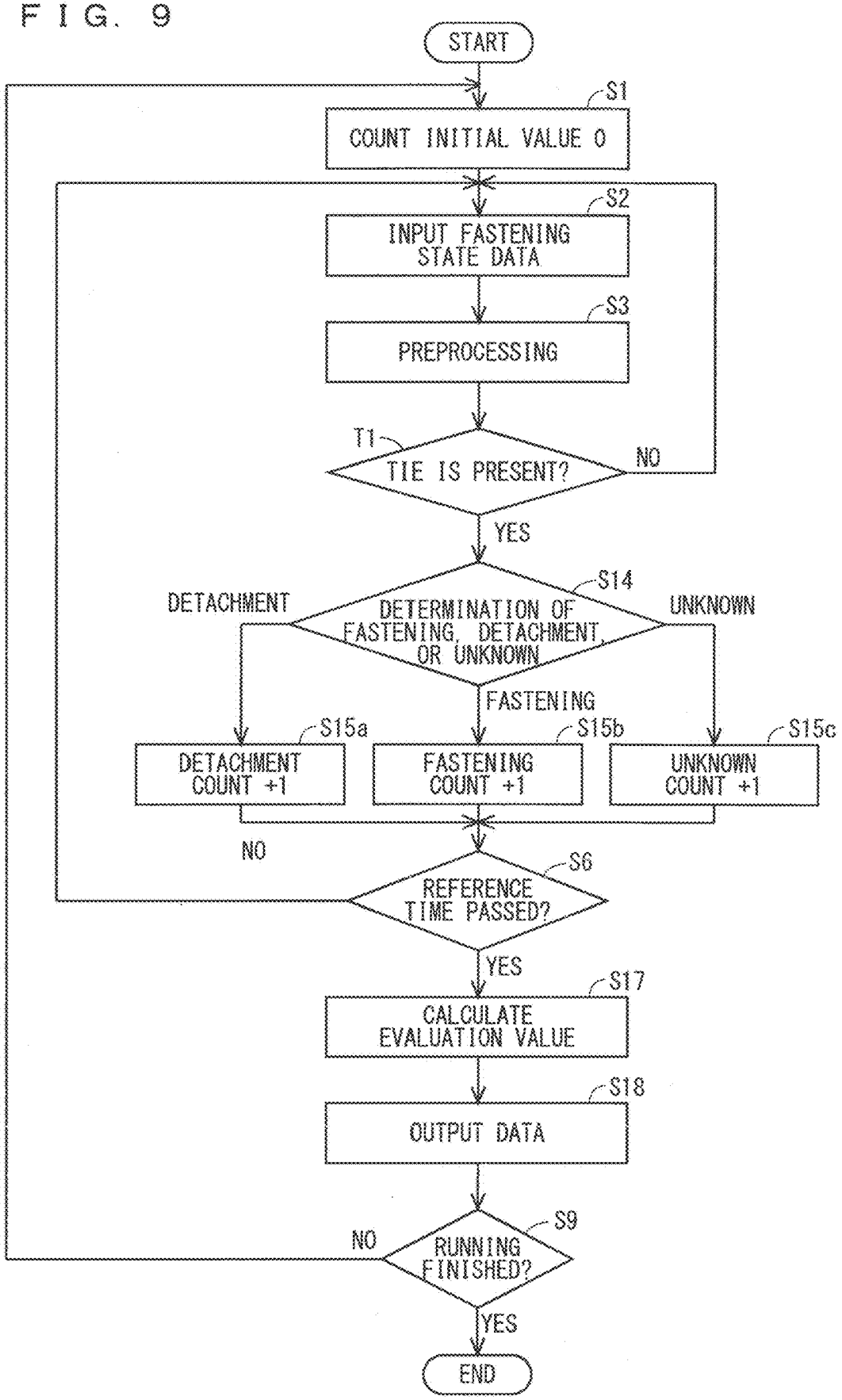
FIG. 9 is a flow chart illustrating another processing example of the fastener monitoring device.

Described based on a premise of the learned model 80 described above is a processing example of calculating the number of unknown of fastening of the fastener 14 per unit length of the track 10 with reference to a flow chart illustrated in FIG. 9. This description is based on a premise that the learned model 80 is a model in which the image G1 group including the fastener 14 and the image G2 group including the trace from which the fastener 14 is detached are mechanically learned as the training data. When the image G2 is inputted, a score indicating a possibility that the fastener 14 is present and a score indicating a possibility that detachment of the fastener 14 is present are outputted. When the score indicating the possibility that the fastener 14 is present is equal to or larger than a predetermined reference value, it is determined that the fastener 14 is present. When the score indicating the possibility that detachment of the fastener 14 is present is equal to or larger than a predetermined reference value, it is determined that detachment of the fastener 14 is present. When the score takes a value therebetween, it is determined that the fastening state of the fastener 14 is unknown.

The mechanical learning device 85 is used to learn presence or absence of the fastener 14 or presence or absence of detachment thereof during running of a railroad car, but may also be a device different from the railroad car, thus is connected to the railroad car via a network, for example. The mechanical learning device 85 may be built in the railroad car, or may also be in a cloud server.

The flow chart illustrated in FIG. 9 is different from the flow chart illustrated in FIG. 4 in the following point. That is to say, Step T1 is executed subsequent to Step S3 in FIG. 4. Presence or absence of the tie 13 is determined in Step T1. Presence or absence of the tie 13 may be determined by performing template matching processing on the fastening state data (image), or may also be determined by the learned model 80 in which the image including the tie 13 is mechanically learned as the training data. Processing returns to the step S2 when it is determined that there is no tie 13, and processing proceeds to the step S14 when it is determined that the tie 13 is present.

Figure 4:
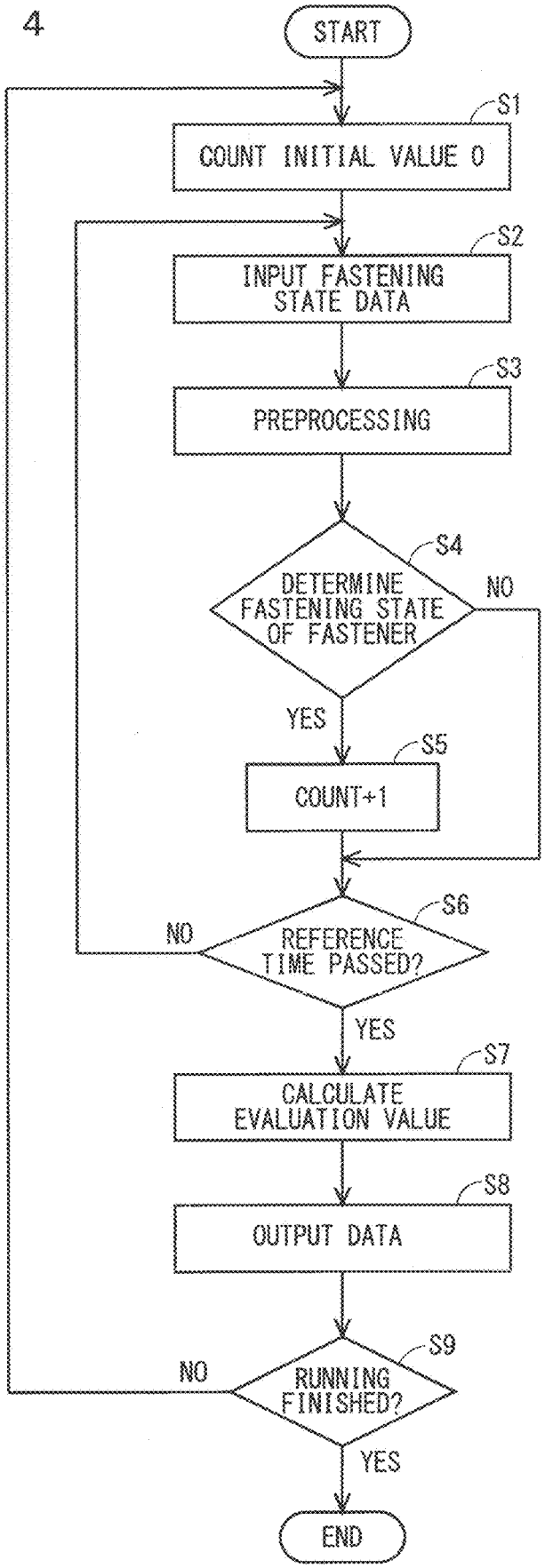
FIG. 4 is a flow chart illustrating a processing example of the fastener monitoring device.

Step S14 is processing performed in place of Step S4 in FIG. 4. It is determined in Step S14 whether the fastener 14 is present, detachment is present, or presence or absence is unknown based on the fastening state data. The present processing may be performed by applying the fastening state data (image) to the learned model 80 as described above, for example. It is also applicable that template matching processing of determining presence or absence of the fastener 14 and template matching processing of determining detachment of the fastener 14 are executed, and it is determined that the presence or absence is unknown when the matching is not established in both determinations.

When it is determined that the fastener 14 is present in Step S14, processing proceeds to Step S15*b*, and 1 is added to a fastening count variable. When it is determined that detachment of the fastener 14 is present, processing proceeds to Step S15*a*, and 1 is added to a detachment count variable. When it is determined that the fastening state of the fastener 14 is unknown, processing proceeds to Step S15*c*, and 1 is added to an unknown count variable.

After Steps S15*a*, S15*b*, and S15*c*, processing proceeds to a step S6. The number of fastening, the number of detachment, and the number of unknown in the reference time are counted by repeating the processing described above until the reference time passes.

In next Step S17, each of the number of fastening, the number of detachment, and the number of unknown per unit reference time is multiplied by an average speed in the manner similar to Step S7, thus the number of fastening, the number of detachment, and the number of unknown per unit length of the track 10 are calculated as the evaluation values.

In next Step S18, each calculated data is outputted. FIG. 10 illustrates an example that the outputted data is displayed in the display device 59. In FIG. 10, the number of fastening, the number of detachment, and the number of unknown per unit length (1 m and 25 m) are displayed as a monitoring index. As described above, the track association data 56*d* is transmitted to the base side state monitoring device 70. The base side state monitoring device 70 may monitor the fastening state of the track 10 based on the track association data 56*d*.

As indicated in Step S9, the above processing is repeated until the running is finished, and the processing is finished when the running is finished.

Figure 11:
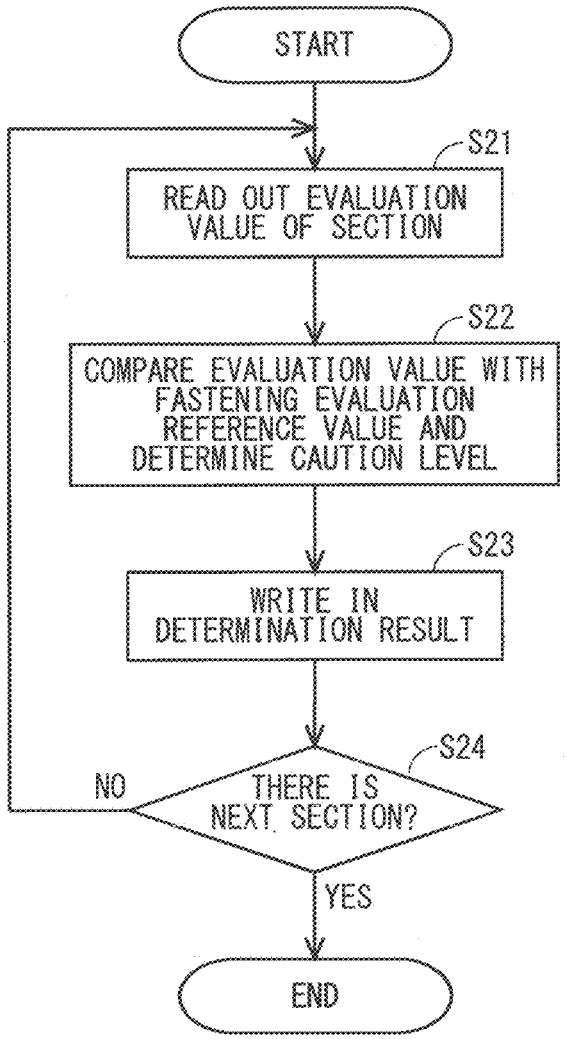
FIG. 11 is a flow chart illustrating a processing example of a base side state monitoring device.

FIG. 11 is a flow chart illustrating a processing example in the base side state monitoring device 70. The processor 72 in the base side state monitoring device 70 performs processing in accordance with the program 74*a*, thus processing as a fastening evaluation processing unit is executed.

That is to say, in Step S21, the evaluation value in any evaluation target section is read out in the track association data 56*d* stored in the storage device 74. The evaluation value is the number of fastening of the fastener 14 or the number of detachment thereof per unit length. The unit length herein may be different from that in the fastener monitoring device 50. For example, the unit length may be a length in which evaluation values of a plurality of sections in the track association data 56*d* are aggregated.

In next Step S22, the evaluation value is compared with a preset fastening evaluation reference value, and a caution level is determined. For example, when the number of the fasteners 14 per unit length is small, a degree of necessity of maintenance check increases. Thus, a plurality of fastening evaluation reference values are previously set in accordance with a degree of necessity (caution level) of maintenance check. The evaluation value is compared with the fastening evaluation reference value, thus the caution level in the section is determined. The caution level indicates the quality of the fastening state of the track 10. The caution level may be two levels simply indicating necessity of attention, or multiple levels are also applicable.

In next Step S23, the data in which the caution level is associated with the section is stored in the storage device 74.

In next Step S24, necessity of a next section whose caution level should be determined is determined. When there is a next section, the processing returns to Step S21, and the above processing is repeated. Accordingly, the caution level is determined for each section in the continuous track 10. When there is no next section, the processing is finished.

Figure 12:
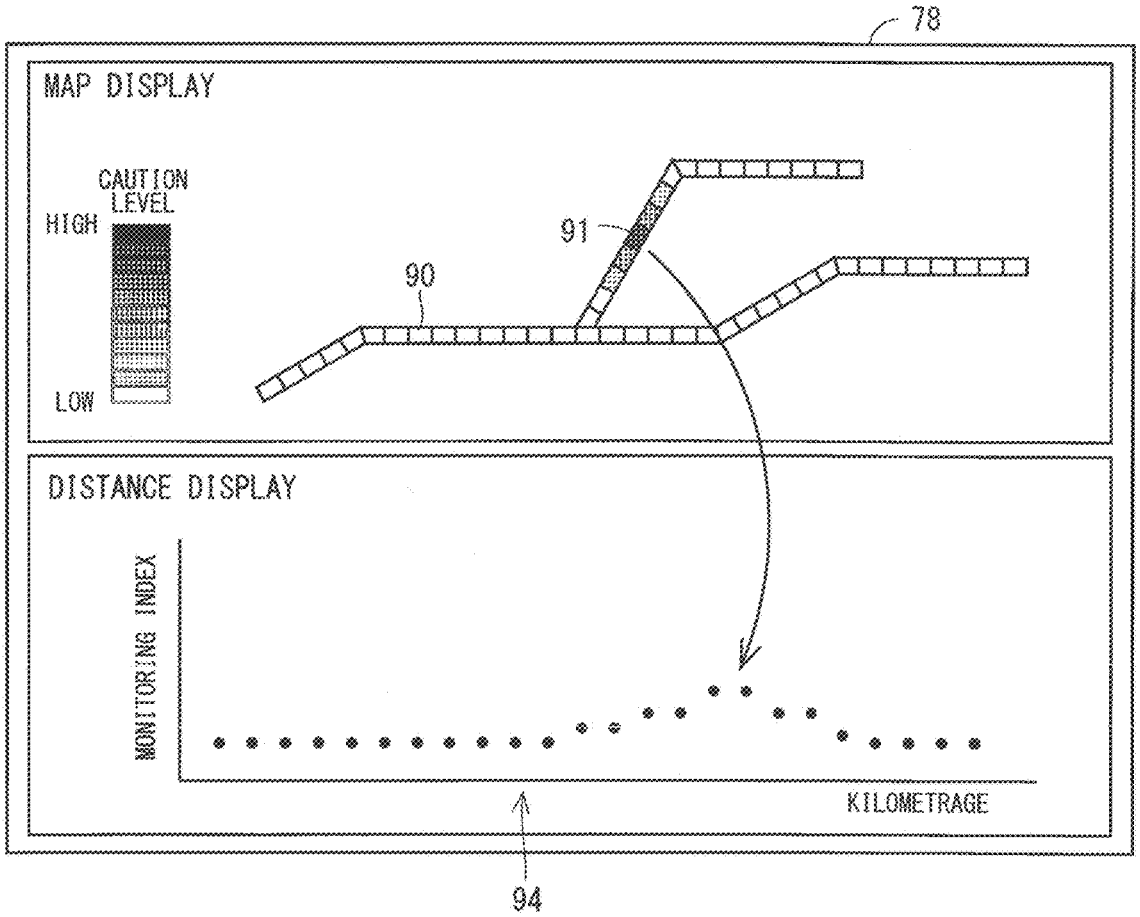
FIG. 12 is a diagram illustrating a display example in the display device in a management base.

FIG. 12 is an image example in which the fastening state of the fastener 14 is associated with each position (each section) of the track 10. This image is displayed in the display device 78 in the base side state monitoring device 70.

The image includes a track image 90 expressing an actual track route. The track image 90 includes an attention image 91 displaying the caution level. The attention image 91 may be identified by a color, a contrasting density, or a pattern, for example. For example, the caution level may be distinguished to be a high level as a color makes a transition from a green color to a red color via a yellow color. A position in the track 10 where attention should be given to the fastening state the fastener 14 is easily grasped by seeing this image.

A detailed image 94 expressing the fastening state (for example, the number of detachment) of the fastener 14 is displayed in a range in which the track image 90 is partially enlarged is displayed separately from the track image 90. The detailed image 94 is a graph having a lateral axis indicating a position (for example, kilometrage) in the longitudinal direction of the track 10 and a vertical axis indicating a monitoring index value (for example, the number of detachment) of the fastener 14. The detailed image 94 may be displayed by selecting a part of the track image 90 by a click or a touch operation, for example. A state of a part of the track 10 can be grasped more specifically by this detailed image.

According to the fastener monitoring device 50, the fastener monitoring system 30, and the fastener monitoring method having such a configuration, the number of fastening of the fastener 14 or the number of detachment thereof per unit length of the track 10 is calculated as the index value indicating the fastening state of the fastener 14 in the track 10. Thus, there is no need to individually manage the fastener 14 by allocating a specific number to the individual fastener 14, and a data processing amount caused by a separate management of the fastener number is reduced.

The number of fastening of the fastener 14 or the number of detachment thereof per unit predetermined time is obtained, and the obtained value is multiplied by the speed of the railroad car 20, thus the index value indicating the fastening state of the fastener 14 can be easily obtained. For example, the index value indicating the fastening state of the fastener 14 can be obtained without managing a position where the fastener 14 is located.

The first unit length (for example, 1 m) and the second unit length (for example, the length of the rail) larger than the first unit length are set as the unit length of the track 10. Thus, the fastening state of the fastener 14 in the track 10 can be monitored by the length of the rail as a unit, for example. The fastening state of the fastener 14 is minutely monitored per unit shorter than the length of the rail, for example.

The number of fastening of the fastener 14 per unit length is calculated as the index value, thus the number of the fasteners 14 actually fastening the rail 12 can be grasped.

The number of detachment of the fastener 14 per unit length is calculated as the index value, thus the fastening state of the rail 12 can be grasped based on the number of detachment even in a state where the number of fastening of the original fastener 14 is unknown.

The fastener monitoring device 50 is provided to the railroad car 20 to sequentially calculate the number of fastening of the fastener or the number of detachment thereof per unit length of the track 10 during running of the railroad car 20, thus the fastening state of the track 10 can be evaluated in real time during running of the railroad car 20.

At this time, when the calculation result in the fastener monitoring device 50 is displayed in the display device 59 as the index value or the quality determination result based on the index value, the fastening state of the rail 12 can be grasped in real time by a user during running of the railroad car 20.

The fastener monitoring device 50 generates the track association data 56*d* in which the number of fastening of the fastener 14 or the number of detachment thereof per unit length of the track 10 is associated with the position of the track 10, thus the number of fastening of the fastener 14 or the number of detachment thereof can be subsequently associated with the position of the track 10 to manage the track 10.

The track association data 56*d* is transmitted to the base side state monitoring device 70, thus the fastening state of the fastener 14 in the track 10 can be monitored in the base side state monitoring device 70.

When presence or absence of the fastener 14 or presence or absence of detachment thereof described above is determined by applying the learned model, presence or absence of the fastener 14 or presence of absence of detachment thereof can be accurately determined even if the fastener 14 is detected in various aspects in an external environment factor.

The number of unknown fastening per unit length of the track 10 is calculated as the reference information, thus the fastening state of the rail 12 can be monitored also in consideration of the determination accuracy.

The quality of the fastening state of the track 10 can be monitored based on the comparison with the preset fastening evaluation reference value in the base side state monitoring device 70. Accordingly, a uniform determination standard can be applied.

The image (track image 90 and attention image 91) in which the fastening state of the fastener 14 is associated with the position of the track 10 and the detailed image 94 are displayed in the management base 28. Accordingly, the fastening state of the fastener 14 can be grasped in association with the position of the track 10.

It is not necessary to mount the fastener monitoring device 50 described above to the railroad car 20. It is also applicable that the running data acquired in the running state acquisition unit 32 in the railroad car 20 and the fastening state data detected in the fastening state detection unit 40 are transmitted to the fastener monitoring device provided on the side of the base via the communication network 16, for example, and the processing similar to that in the fastener monitoring device 50 described above may be performed in the fastener monitoring device on the side of the base. In this case, the processing of determining presence or absence of the fastener 14 or presence or absence of detachment thereof based on the fastening state data may be performed in the railroad car 20.

Each configuration described in the above-mentioned embodiments and each modification example can be combined with each other as appropriate unless any contradiction occurs.

The present specification and the drawings disclose each aspect described hereinafter.

When the fastener monitoring device described in the section of means to solve the problem is a first aspect, a second aspect is the fastener monitoring device according to the first aspect, wherein the processing unit obtains a total number of fastening of the fastener or a total number of detachment of the fastener per unit time based on the running data and the fastening state data of the fastener, and obtains a total number of fastening of the fastener or a total number of detachment of the fastener per unit length of the track by multiplying a value which has been obtained by a speed of the railroad car. Accordingly, the number of fastening of the fastener or the number of detachment thereof per unit predetermined time is obtained, and the obtained value is multiplied by the speed of the railroad car, thus the index value indicating the fastening state of the fastener can be easily obtained.

A third aspect is the fastener monitoring device according to the first or second aspect, wherein a first unit length and a second unit length larger than the first unit length are set as the unit length of the track, and the processing unit calculates the total number of fastening of the fastener or the total number of detachment of the fastener per the first unit length based on the running data of the railroad car and the fastening state data of the fastener during running of the railroad car, and calculates the total number of fastening of the fastener or the total number of detachment of the fastener per the second unit length based on a calculation result of the calculation. Accordingly, the fastening state of the fastener changed per first unit length smaller than the second unit length can be monitored. Then, the fastening state of the fastener can be monitored per second unit length larger than the first unit length.

A fourth aspect is the fastener monitoring device according to any one of the first to third aspects, wherein the processing unit calculates a total number of fastening of the fastener per unit length of the track. Accordingly, the fastening state of the fastener in the track can be monitored by the number of fastening of the fastener determined to be present in the track.

A fifth aspect is the fastener monitoring device according to any one of the first to fourth aspects, wherein the processing unit calculates a total number of detachment of the fastener per unit length of the track. Accordingly, the fastening state of the fastener in the track can be monitored by the number of detachment of the fastener in the track.

A sixth aspect is the fastener monitoring device according to any one of first to fifth aspects, wherein when the fastening state includes a state where the fastening state of the fastener during running of the railroad car is unknown, the processing unit calculates a total number of unknown of fastening of the fastener per unit length of the track as reference information. Accordingly, the number of unknown of fastening of the fastener per unit length of the track is served to a user as the reference information. The user grasps the fastening state of the fastener while referring to the reference information.

A seventh aspect is the fastener monitoring device according to any one of the first to sixth aspects, wherein learning data including the fastening state data of the fastener and correct data of the fastening state of the fastener is acquired, and a learned model for estimating the fastening state of the fastener during running of the railroad car is generated using the learning data. Accordingly, the learned model for estimating the fastening state of the fastener can be generated using the learning data.

An eighth aspect is the fastener monitoring device according to any one of the first to seventh aspects, wherein the processing unit includes an inference unit in which the fastening state data of the fastener is inputted to a learned model, on which a mechanical learning for estimating the fastening state of the fastener is performed, so that at least one of presence or absence of the fastener or presence or absence of detachment of the fastener is determined. At least one of presence or absence of the fastener or presence or absence of detachment thereof is determined by the learned model by mechanical learning.

A ninth aspect is the fastener monitoring device according to any one of the first to eighth aspects, comprising: a running state acquisition unit provided to the railroad car, acquiring a running state of the railroad car, and outputting running data; and a fastening state detection unit provided to the railroad car, detecting a fastening state of the fastener during running of the railroad car, and outputting fastening state data, wherein the processing unit provided to the railroad car calculates a total number of fastening of the fastener or a total number of detachment of the fastener per unit length of the track based on the running data and the fastening state data during running of the railroad car. Accordingly, the number of fastening of the fastener and the number of detachment thereof per unit length of the track can be grasped during running of the railroad car.

A tenth aspect is the fastener monitoring device according to the ninth aspect, further comprising a display device displaying the fastening state of track during running of the railroad car based on a calculation result by the processing unit. Accordingly, the fastening state of the track is displayed in the display device during running of the railroad car.

An eleventh aspect is the fastener monitoring device according to the ninth or tenth aspect, wherein the running data of the railroad car includes running position information of the railroad car, and the processing unit generates data in which the total number of fastening of the fastener or the total number of detachment of the fastener per unit length of the track is associated with a position of the track. Accordingly, the fastening state of the track can be monitored based on the data in which the number of fastening of the fastener or the number of detachment thereof per unit length of the track is associated with the position of the track.

When the fastener monitoring system described in the section of means to solve the problem is a twelfth aspect, a fastener monitoring system according to a thirteenth aspect is the fastener monitoring system according to the twelfth aspect, wherein the base side state monitoring device includes a base side processing unit comparing the total number of fastening of the fastener or the total number of detachment of the fastener per unit length of the track with a preset reference value, and determining a quality of a fastening state of a track. Accordingly, the track state can be monitored based on the comparison with the preset reference value in the base side state monitoring device.

A fastener monitoring system according to a fourteenth aspect is the fastener monitoring system according to the twelfth or thirteenth aspect, wherein an image in which the fastening state of the fastener is associated with the position of the track is displayed in the management base. Accordingly, the user of the management base can easily grasp the fastening state of the fastener associated with the position of the track.

When the fastener monitoring method described in the section of means to solve the problem is a fifteenth aspect, a fastener monitoring method according to a sixteenth aspect is the fastener monitoring method according to the fifteenth aspect, wherein in the calculation processing (c), a total number of fastening of the fastener or a total number of detachment of the fastener per unit time is obtained, a value which has been obtained is multiplied by a speed of the railroad car, and a total number of fastening of the fastener or a total number of detachment of the fastener per unit length of the track is obtained. Accordingly, the number of fastening of the fastener or the number of detachment thereof per unit predetermined time is obtained, and the obtained value is multiplied by the speed of the railroad car, thus the index value indicating the fastening state of the fastener can be easily obtained.

A seventeenth aspect is the fastener monitoring method according to the fifteenth or sixteenth aspect, wherein in the calculation processing (c), a total number of fastening of the fastener or a total number of detachment of the fastener per first unit length is calculated, and a total number of fastening of the fastener or a total number of detachment of the fastener per second unit length larger than the first unit length is calculated based on a calculation result of the calculation. Accordingly, the fastening state of the fastener changed per first unit length shorter than the second unit length can be monitored. Then, the fastening state of the fastener can be monitored per second unit length larger than the first unit length.

According to the fastener monitoring device and the fastener monitoring method, the number of fastening or detachment of the fastener per unit length of the track is calculated as the index value indicating the fastening state of the fastener in the track, thus the data processing amount caused by the separate management of the fastener number can be significantly reduced.

According to the fastener monitoring system, the fastener can be monitored in the base side monitoring device in the management base.

The foregoing description is in all aspects illustrative and does not restrict the present invention. It is understood that numerous unillustrated modifications can be devised without departing from the scope of the present invention.

EXPLANATION OF REFERENCE SIGNS

10 track
14 fastener
16 communication network
20 railroad car
28 management base
30 fastener monitoring system
32 running state acquisition unit
40 fastening state detection unit
50 fastener monitoring device
52 processor
52*a* fastening state determination unit
52*b* index value calculation unit
56 storage device
56*a* program
56*b* running history data
56*c* fastening state history data
56*d* track association data
59 display device
70 base side state monitoring device
72 processor
74 storage device
74*a* program
74*c* reference value data
78 display device
80 learned model
90 track image
91 attention image
94 detailed image

The invention claimed is:

1. A fastener monitoring device monitoring a fastener of a track on which a railroad car runs, comprising processing circuitry configured to calculate a total number of fastening of the fastener or a total number of detachment of the fastener per unit length of the track as an index value indicating a fastening state of the fastener in the track based on running data of the railroad car and fastening state data of the fastener during running of the railroad car.

2. The fastener monitoring device according to claim 1, wherein the processing circuitry is configured to obtain a total number of fastening of the fastener or a total number of detachment of the fastener per unit time based on the running data and the fastening state data of the fastener, and obtain a total number of fastening of the fastener or a total number of detachment of the fastener per unit length of the track by multiplying a value which has been obtained by a speed of the railroad car.

3. The fastener monitoring device according to claim 2, wherein a first unit length and a second unit length larger than the first unit length are set as the unit length of the track, and the processing circuitry is configured to calculate the total number of fastening of the fastener or the total number of detachment of the fastener per the first unit length based on the running data of the railroad car and the fastening state data of the fastener during running of the railroad car, and calculate the total number of fastening of the fastener or the total number of detachment of the fastener per the second unit length based on a calculation result of the calculation.

4. The fastener monitoring device according to claim 2, wherein learning data including the fastening state data of the fastener and correct data of the fastening state of the fastener is acquired, and a learned model for estimating the fastening state of the fastener during running of the railroad car is generated using the learning data.

5. The fastener monitoring device according to claim 1, wherein a first unit length and a second unit length larger than the first unit length are set as the unit length of the track, and the processing circuitry is configured to calculate the total number of fastening of the fastener or the total number of detachment of the fastener per the first unit length based on the running data of the railroad car and the fastening state data of the fastener during running of the railroad car, and calculate the total number of fastening of the fastener or the total number of detachment of the fastener per the second unit length based on a calculation result of the calculation.

6. The fastener monitoring device according to claim 1, wherein the processing circuitry is configured to calculate a total number of fastening of the fastener per unit length of the track.

7. The fastener monitoring device according to claim 1, wherein the processing circuitry is configured to calculate a total number of detachment of the fastener per unit length of the track.

8. The fastener monitoring device according to claim 1, wherein when the fastening state includes a state where the fastening state of the fastener during running of the railroad car is unknown, the processing circuitry is configured to calculate a total number of unknown fastening of the fastener per unit length of the track as reference information.

9. The fastener monitoring device according to claim 1, wherein learning data including the fastening state data of the fastener and correct data of the fastening state of the fastener is acquired, and a learned model for estimating the fastening state of the fastener during running of the railroad car is generated using the learning data.

10. The fastener monitoring device according to claim 1, wherein the processing circuitry includes inference circuitry in which the fastening state data of the fastener is inputted to a learned model, on which mechanical learning for estimating the fastening state of the fastener is performed, so that at least one of presence or absence of the fastener or presence or absence of detachment of the fastener is determined.

11. The fastener monitoring device according to claim 1, comprising:

a running state acquirer provided to the railroad car, configured to acquire a running state of the railroad car, and output running data; and a fastening state detector provided to the railroad car, configured to detect a fastening state of the fastener during running of the railroad car, and output fastening state data, wherein the processing circuitry provided to the railroad car is configured to calculate a total number of fastening of the fastener or a total number of detachment of the fastener per unit length of the track based on the running data and the fastening state data during running of the railroad car.

12. The fastener monitoring device according to claim 11, further comprising a display configured to display the fastening state of the track during running of the railroad car based on a calculation result by the processing circuitry.

13. The fastener monitoring device according to claim 11, wherein the running data of the railroad car includes running position information of the railroad car, and the processing circuitry is configured to generate data in which the total number of fastening of the fastener or the total number of detachment of the fastener per unit length of the track is associated with a position of the track.

14. A fastener monitoring system, comprising:

the fastener monitoring device according to claim 11; and a base side state monitoring device provided to a management base so that a processing circuitry in the fastener monitoring device is transmitted via a communication network.

15. The fastener monitoring system according to claim 14, wherein the base side state monitoring device includes base side processing circuitry configured to compare the total number of fastening of the fastener or the total number of detachment of the fastener per unit length of the track with a preset reference value, and determine a quality of a fastening state of a track.

16. The fastener monitoring system according to claim 14, wherein an image in which the fastening state of the fastener is associated with a position of the track is displayed in the management base.

17. A fastener monitoring method of monitoring a fastener of a track on which a railroad car runs, comprising:

detecting a running state of the railroad car and a fastening state of the fastener during running of the railroad car;

determining at least one of presence or absence of the fastener or presence or absence of detachment of the fastener based on a detection result of the fastening state of the fastener; and calculating a total number of fastening of the fastener or a total number of detachment of the fastener per unit length of the track as an index value indicating a fastening state of the fastener in the track based on a running state of the railroad car which has been detected and a determination result of at least one of presence or absence of the fastener or presence or absence of detachment of the fastener.

18. The fastener monitoring method according to claim 17, wherein in the calculating, a total number of fastening of the fastener or a total number of detachment of the fastener per unit time is obtained, a value which has been obtained is multiplied by a speed of the railroad car, and a total number of fastening of the fastener or a total number of detachment of the fastener per unit length of the track is obtained.

19. The fastener monitoring method according to claim 18, wherein in the calculating, a total number of fastening of the fastener or a total number of detachment of the fastener per first unit length is calculated, and a total number of fastening of the fastener or a total number of detachment of the fastener per second unit length larger than the first unit length is calculated based on a calculation result of the calculation.

20. The fastener monitoring method according to claim 17, wherein in the calculating, a total number of fastening of the fastener or a total number of detachment of the fastener per first unit length is calculated, and a total number of fastening of the fastener or a total number of detachment of the fastener per second unit length larger than the first unit length is calculated based on a calculation result of the calculation.

* * * * *